United States Patent [19]

Butler

[11] 3,950,574

[45] Apr. 13, 1976

[54] HUMIDIFICATION OF PANELS OF CELLULOSIC MATERIAL

[75] Inventor: Paul A. Butler, Roxboro, Canada

[73] Assignee: Abitibi Paper Company, Ltd., Toronto, Canada

[22] Filed: Aug. 27, 1974

[21] Appl. No.: 500,930

[30] Foreign Application Priority Data

Feb. 8, 1974 Canada ..... 192057

[52] U.S. Cl. ..... 427/209; 427/336; 427/353; 427/424

[51] Int. Cl.[2] .... B05C 9/04; B05D 3/00; B05D 1/02

[58] Field of Search ..... 117/60, 63, 68, 152, 105.3; 427/209, 336, 353, 424

[56] References Cited

UNITED STATES PATENTS 3,625,743 12/1971 Watanabe ..... 117/152 X

*Primary Examiner*—Michael R. Lusignan

*Attorney, Agent, or Firm*—Spencer & Kaye

[57] ABSTRACT

A method of humidifying a panel of cellulosic material, at least one side of which has a surface through which the panel can absorb water. A liquid humidifying agent is applied to the panel surface which wets the surface of the panel, which is soluble in water, and which reduces the surface tension of the water. Water is also applied to the panel to cause the water to follow the humidifying agent into the panel to increase its moisture content to a desired value.

13 Claims, 1 Drawing Figure

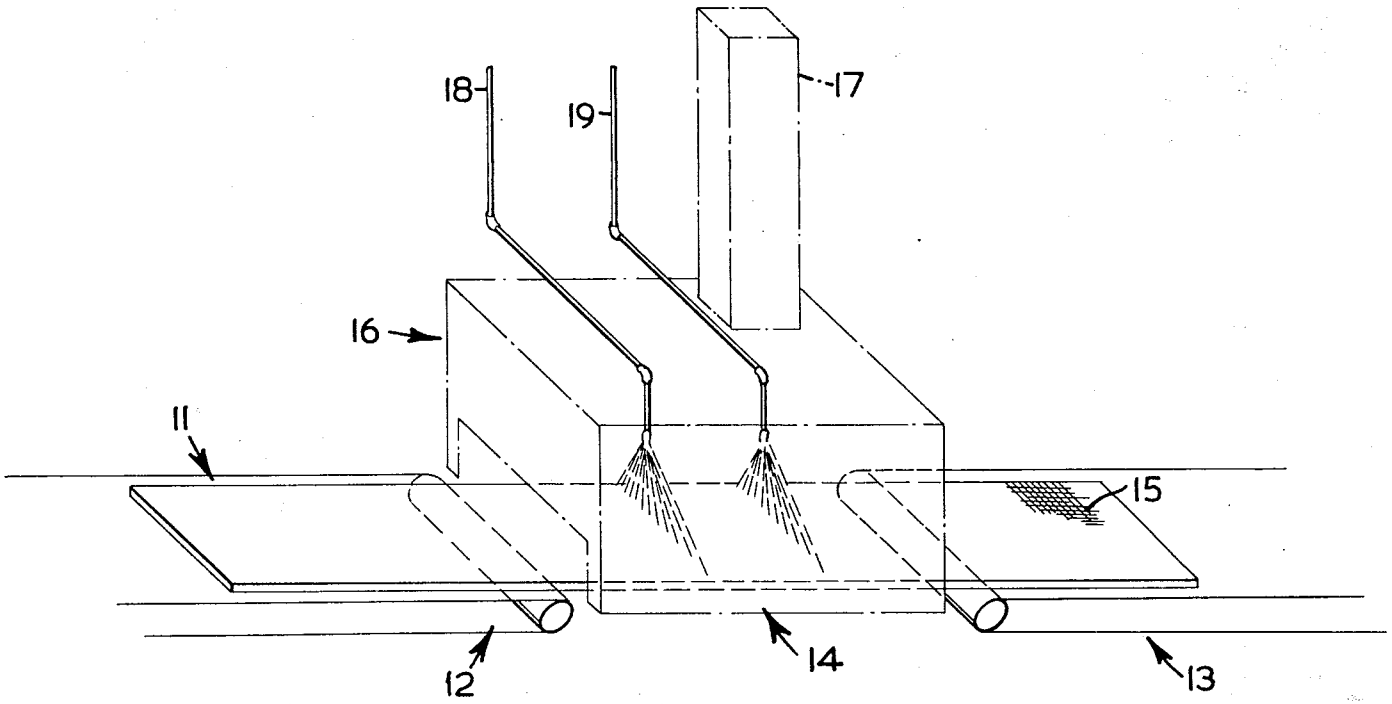
11
12
13
14
15
16
17
18
19

HUMIDIFICATION OF PANELS OF CELLULOSIC MATERIAL

This invention relates to the humidification of panels of cellulosic material.

Such panels are in common use in buildings, and ways of speeding up production and improving the product are constantly being sought. At the present time, panels of ligno-cellulosic material are in common use, that is to say panels made from wood treated in various ways, according to the panel properties required, as is well known. It is also expected that, in the future, panels of cellulosic materials, other than wood, will be commercially attractive.

After manufacture, panels may be packaged and stored for a considerable period of time, and it is important that during this time the panels should contain an amount of moisture consistent with that found in normal atmospheric conditions, otherwise the panel may undergo undesirable changes in size or shape after installation.

When leaving the production line, panels usually have a moisture content which is lower than that required for satisfactory storage. In other words, they are too dry. This is particularly true, for example, when one face of the panel is painted, since painting processes used commercially dry out the panels to a considerable extent. In any event, it is desirable for the panels to be relatively dry at the painting stage, since a better painting finish is achieved with a relatively dry panel, particularly with solvent-based paints.

It is thus usually necessary to raise the moisture content of a panel, after its manufacture, to some satisfactory value suitable for storage. This problem is well known, and many prior attempts have been made to provide a humidification process which is satisfactory, both technically and commercially. The main problem with known processes is the length of time required for satisfactory humidification. Present day processes which are commercially used require a time of the order of one hour for humidification. Although this is much shorter than earlier known processes, it is still undesirably long, having regard to the rate at which the panels can be produced. These present day processes also require the use of humidification chambers maintained at a controlled humidity and elevated temperature.

It is therefore an object of the invention to provide a humidification process which does not possess these disadvantages.

In accordance with the invention, panels of cellulosic materials are satisfactorily humidified, after production, to a desired moisture content suitable for storage purposes by applying to the panel a liquid humidifying agent which wets the surface of the panel, which is soluble in water and which reduces its surface tension, and then applying water to the panel.

Quite unexpectedly, the application of the liquid humidifying agent enables the humidification process to be satisfactorily carried out very quickly. For some reason which is not yet fully understood, the humidifying agent precedes the water into the panel, and enables the panel to take up the water very quickly. For example, in one embodiment of the process, which will be described in more detail later, panels travelling at 135 ft/min were passed under sprays of humidifying agent and water, and less than one minute later were packaged. By adjusting the rate of application of the humidifying agent and the water, which can be done by routine trial and experiment, the moisture content of the panel can be brought up to a desired value, the water pick-up by the panel with the assistance of the humidifying agent being fast enough in the short time between application of the liquids and packaging to enable this to be achieved. Under the conditions just mentioned, it is possible to bring the moisture content of a panel up from 1% to 7%, the former value being a typical value after the painting process, and the latter value being a desirable value for storage.

Further advantages of the invention, besides the short time required, are that the humidification operation does not have to be carried out at the substantially elevated temperatures, and does not require the use of a humidifying chamber. The saving on cost is therefore considerable.

Thus the present invention enables time and cost of humidification to be very considerably reduced, while at the same time providing a satisfactory humidification.

It is advantageous if the humidifying agent is fugitive, that is to say is not permanently retained by the panel. This reduces any likelihood of the humidifying agent causing any long term undesirable effect on the panel.

As mentioned above, the liquid humidifying agent has to wet the surface of the panel, must be soluble in water (that is to say miscible with water) and must reduce the surface tension of water. The man skilled in the art will readily be able to suggest suitable liquids, and to ascertain their suitability for the process by routine trial and experiment.

Although the humidifying agent can be applied in concentrated form, it may be sufficient to supply it diluted with water. Again, this can be determined by routine experiment.

Commercially acceptable humidifying agents are methanol, isopropanol, and acetone. Standard tests carried out with these liquids have established that satisfactory humidification can be carried out using these liquids as humidifying agents without causing any harmful effects to the panels. They also have the advantage that they are fugitive, the advantage of which has been previously mentioned.

Although the humidifying agent and water may be applied to the panel in any suitable manner, the preferred way is to spray the liquids downwardly onto the upper surface of a panel as it travels horizontally. This method achieves a good pick-up of water by the panel in a given time. Instead of spraying, the liquids could be applied to the panels by rollers or by dipping the panels in the liquids. It is also possible to apply the liquids to a panel with the panel in an orientation other than horizontal. For example, a vetical orientation could be used, and the liquids could be sprayed onto the vertical panel. These variations are all within the scope of the invention, although as indicated above, it is preferred to spray the liquids downwardly onto the upper surface of a horizontally moving panel, as this particular process has production line advantages over the other variations.

This preferred process is especially advantageous where, as is very frequently the case, one face of the panel is painted or similarly treated. The painted face cannot absorb water and must be protected from damage. The panel can therefore be conveyed horizontally with its painted face downward, protected from damage and out of the line of the sprays, with the sprays being directed at the upper or rear face of the panel, which can absorb water. The rear face may have what is commonly known as a screenback or grid-like pattern or it may be plain.

One embodiment of the invention will now be described, by way of example, with reference to the accompanying drawing, which shows a diagrammatic view of a humidification process.

In this embodiment, the panels are of ligno-cellulosic material and are of the kind known as pressed fibreboard, intended for use as wall siding panels on the outside of a building. Such panels are becoming popular at the present time as a substitute for siding panels of metal, for example, aluminum. The drawing shows a panel 11 travelling horizontally along a production line after leaving the painting stage. As shown, the panel 11 travels on belt conveyors, and is shown passing from one belt conveyor 12 to a subsequent belt conveyor 13, with a gap 14 between the two conveyors 12, 13.

The panel 11 has a lower painted face (not shown) and an upper screenback face 15. It is one foot wide, sixteen feet long, and 7/16 inches thick. The conveyors 12, 13 move the panel 11 at 135 ft/min. from left to right in the drawing. As previously mentioned, the panel 11 has just left the painting stage, and its temperature is around 100°F, that is to say slightly higher than normal room temperature.

A spray housing 16 is mounted above the panel 11 over the gap 14 between the conveyors 12, 13. The housing 16 is open at the bottom, and has a ventilation conduit 17 at its upper end. The spray housing 16 contains two sprays, namely a first spray 18 of humidifying agent, followed by a second spray 19 of water. Thus, as the panel 11 travels past the lower end of the spray housing 16, the upper surface 15 of the panel receives a spray of humidifying agent followed by a spray of water.

The humidifying agent applied by spray 18 is methanol, and is supplied as an aqueous solution, with 10% by volume of ethanol, at such a rate as to apply 40 ml of solution to the upper surface of each panel, the temperature of the solution being 70°F. The water applied by spray 19 is supplied at such a rate as to apply 750 ml of water to the upper surface of each panel. Generally speaking, for most effective and economical results, it has been found that the volume of water applied to the panel should be between about 15 to 18 times the volume of pure humidifying agent.

After leaving the spraying area, the panel 11 is conveyed to a packaging area (not shown), which it reaches in approximately 45 seconds. Each alternate panel 11 is there turned the other way up, so that its screenback face 15 contacts the screenback face 15 of another panel. Three such pairs of panels are placed one on top of the other, and the resulting group of six panels is packaged to form a single package.

Tests have shown that panels arrived at the spraying area from the painting operation with a moisture content of approximately 1%, and when packaged had a moisture content of 7%, which was the desired value. By the time the panels reached the packaging area from the spraying area, virtually all the water sprayed onto the upper surface of the panels had been absorbed into the panel. Similar results were achieved with isopropanol and acetone as humidifying agents.

It will thus be seen that the humidification process of the invention enables the panel to be humidified to a desired value quickly without any requirement for special humidifying chambers in which the panels must remain, and without elevated temperatures having to be produced for this purpose. In fact, it was found that heating the water applied did not result in any appreciable improvement. It will also be seen that the humidification process according to the invention can be carried out at the end of the normal production line of the panels, and that no substantial delay is necessary before packaging.

The invention is applicable to different types of pressed fibreboard, for example low density insulation board and medium density board, as well as hardboard.

I claim:

1. A method of humidifying a panel of cellulosic material, at least one side of which has a surface through which the panel can absorb water, including applying to said surface of the panel a liquid humidifying agent which wets the surface of the panel, which is soluble in water, and which reduces the surface tension of the water, and applying water to the panel to cause the water to follow the humidifying agent into the panel to increase its moisture content to a desired value.

2. A method according to claim 1 wherein the humidifying agent and the water are sprayed onto the panel.

3. A method according to claim 2 wherein the humidifying agent and the water are sprayed downwardly onto the panel, which is oriented horizontally with said surface uppermost.

4. A method according to claim 3 wherein the panel is moved horizontally past the sprays of humidifying agent and water.

5. A method according to claim 1 wherein the humidifying agent is methanol.

6. A method according to claim 1 wherein the humidifying agent is isopropanol.

7. A method according to claim 1 wherein the humidifying agent is acetone.

8. A method according to claim 1 wherein the humidifying agent is applied in aqueous solution.

9. A method according to claim 1 wherein the water is applied substantially at room temperature.

10. A method of humidifying a panel of ligno-cellulosic material, a first side of which has a surface through which the panel can absorb the water, and a second side of which is treated so as to be water repellant, including conveying the panel along a substantially horizontal path with said first side uppermost, spraying downwardly onto said first side a humidifying agent which wets the surface of said first side, which is soluble in water and which reduces the surface tension of water, and spraying water downwardly onto said first side to cause water to follow the humidifying agent into the panel to increase its moisture content to a desired value.

11. A method according to claim 10 wherein the humidifying agent is selected from the group consisting of methanol, isopropanol and acetone.

12. A method according to claim 11 wherein the humidifying agent is applied as an aqueous solution.

13. A method according to claim 10 wherein the humidifying agent and water are applied substantially at room temperature.

* * * * *

UNITED STATES PATENT AND TRADEMARK OFFICE

CERTIFICATE OF CORRECTION

PATENT NO. : 3,950,574

DATED : April 13th, 1976

INVENTOR(S) : Paul A. Butler

It is certified that error appears in the above-identified patent and that said Letters Patent are hereby corrected as shown below:

Column 2, line 54, change "vetical" to --vertical--.

Column 3, line 41, change "ethanol" to --methanol--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*